US006128801A

United States Patent [19]

Adzick et al.

[11] Patent Number: 6,128,801

[45] Date of Patent: Oct. 10, 2000

[54] SHOE SOLE CLEANERS

[75] Inventors: George N. Adzick, Chanhassen; Thomas W. Guyer, Minneapolis, both of Minn.

[73] Assignee: Winsor Corporation, St. Paul, Minn.

[21] Appl. No.: 09/065,946

[22] Filed: Apr. 24, 1998

Related U.S. Application Data

[60] Provisional application No. 60/053,962, Jul. 28, 1997.

[51] Int. Cl.[7] ..... A43B 23/02

[52] U.S. Cl. ..... 15/210.1; 15/227; 36/136

[58] Field of Search ..... 15/210.1, 227; 36/1, 45, 132, 136

[56] References Cited

U.S. PATENT DOCUMENTS

| | | | |
|---|---|---|---|
| 2,069,964 | 2/1937 | Miller | 36/136 |
| 4,697,362 | 10/1987 | Wasserman | 36/136 |
| 4,823,426 | 4/1989 | Bragga | 15/210.1 |
| 5,165,190 | 11/1992 | Smyth | 36/136 |
| 5,209,000 | 5/1993 | Rowland et al. | 36/136 |
| 5,359,790 | 11/1994 | Iverson et al. | 36/45 |
| 5,421,106 | 6/1995 | Emrick | 36/136 |
| 5,459,947 | 10/1995 | Lasher | 36/136 |
| 5,566,447 | 10/1996 | Mathis et al. | 36/136 |
| 5,809,699 | 9/1998 | Hage et al. | 15/227 |
| 5,845,422 | 12/1998 | Valteau, III | 36/136 |

*Primary Examiner*—Theresa T. Snider
*Attorney, Agent, or Firm*—Kinney & Lange, PA

[57] ABSTRACT

A shoe sole cleaner removes foreign debris from a sole of a user's shoe by swiping the sole over the shoe sole cleaner on the user's opposing shoe. The shoe sole cleaner includes a base member and an elongated closure strap extending from the base member. A fixed end of the elongated closure strap extends from the base member and a free end of the elongated closure strap is adapted for extending under at least a portion of a shoelace on the shoe. In one embodiment, facing surfaces of the closure strap and base member have complementary portions of a two-part mechanical fastener (e.g., hook-and-loop) which are engaged to secure the shoe sole cleaner to a shoe by its shoe laces. An exposed surface of the base member bears a shoe sole cleaning surface. In another embodiment, a first part of a hook-and-loop fastener covers substantially an entire outer surface of the base member and a second complementary part of the hook-and-loop fastener covers the free end of the elongated closure strap for detachable attachment to the outer surface of the base member. The shoe sole cleaner also includes a separable shoe sole cleaning sheet having an inner surface covered by a second part of a hook-and-loop fastener for detachable attachment to the outer surface of the base member. Alternatively, the shoe sole cleaner is integral to the shoe and substantially conforms to the profile of the shoe.

18 Claims, 12 Drawing Sheets

112A
132
160
110
120
126
128
124
14
130
112B

SHOE SOLE CLEANERS

This application claims benefit of Provisional Application 60/053,962 filed Jul. 28, 1997.

BACKGROUND OF THE INVENTION

This invention relates to footwear accessories, and more specifically, to portable, durable and unimposing shoe sole cleaners for use in cooperation with footwear to provide instant and effective cleaning of the residue on the soles of shoes while they are being worn, optimizing shoe performance and traction.

As recreational sporting activities have gained popularity, footwear performance has become a significant issue. In the course of sporting footwear development (e.g., from canvas sneakers to specialized athletic footwear for nearly every sporting activity), a foremost concern has been the search for high performance, durable and inexpensive shoes. Most sporting activities require the participant to run, jump or otherwise make quick movements. For optimal playing performance, shoe soles must interact with the playing surface in a consistent and safe manner. The shoe soles must readily respond to the participant's desired movement. If the shoe sole slips on or sticks to the playing surface, the participant will not achieve the desired level of play or can become injured.

Over the years, various materials and designs have been used to improve the performance of athletic footwear soles. Traditional sole materials (e.g., wood, canvas, leather and plastic) have given way to high performance compounds composing athletic footwear soles. Additionally, athletic shoe soles commonly have complex sole designs, including studs and ridges, to increase shoe traction and performance. While great progress has been made in designing high performance footwear soles, the shoe soles remain susceptible to foreign residue (e.g., dirt, dust and condensation) present on the playing surface.

The problem of foreign residue interfering with shoe performance is particularly pronounced while participating in court sports (e.g., basketball, tennis, racquetball, aerobics or similar activities), bowling and sailing. These activities typically require the participants to initiate quick movements, including jumping, turning, running and stopping. Any foreign residue accumulating on the shoe soles can result in a loss of traction and an ineffective movement. Participants desire a way to clean their shoe soles that is convenient, instant, portable and effective.

Court sport participants commonly use a variety of methods to clean their shoe soles while playing. For example, a towel or similar apparatus may be used to wipe foreign residue off the shoe soles. However, the towel method is inconvenient as the towel may only be used during breaks in the action because the towel is kept off-court on the sideline. Further, the towel is not portable as it may not be used to clean the shoe soles while actually playing. To clean their shoe soles while playing, many participants wipe a moistened palm of their hand over their shoe soles. The palm can be moistened from perspiration, a water source or human saliva. The palm method of cleaning is awkward and inefficient because the palm is contoured and does not evenly engage the shoe sole, leaving portions of the shoe sole dirty. Additionally, it is unhealthy for participants to either lick or spit on their hands while playing sports, and the participants' athletic performance may be adversely affected by the dirt or dust deposited on the palm (particularly in sports like basketball or racquetball where a good grip is important). To rectify these drawbacks, some court sport participants swipe their shoe soles across the shoelaces of the shoe on the opposite foot. However, the lace method provides ineffective cleaning as the shoelaces are not uniform in presentation, provide only a limited surface area for cleaning and quickly become coated with dirt or dust. Thus, the present sole cleaning methods are inefficient and only somewhat effective.

BRIEF SUMMARY OF THE INVENTION

The present invention is a shoe sole cleaner for use with footwear for removing foreign debris from a sole of a shoe by swiping the sole over the shoe sole cleaner on the opposing shoe. The shoe sole cleaner includes a base member and an elongated closure strap extending from the base member. A fixed end of the elongated closure strap extends from the base member and a free end of the elongated closure strap is adapted for extending under at least a portion of a shoelace on the shoe. In one embodiment, facing surfaces of the closure strap and base member have complementary portions of a two-part mechanical fastener (e.g., hook-and-loop) which are engaged to secure the shoe sole cleaner to a shoe by its shoe laces. An exposed surface of the base member bears a shoe sole cleaning surface.

In another embodiment, a first part of a hook-and-loop fastener covers substantially an entire outer surface of the base member and a second complementary part of the hook-and-loop fastener covers the free end of the elongated closure strap for detachable attachment to the outer surface of the base member. The cleaning assembly includes a shoe sole cleaning sheet having an inner surface covered by a second part of a hook-and-loop fastener for detachable attachment to the outer surface of the base member.

BRIEF DESCRIPTION OF THE DRAWINGS

The present invention will be further explained with reference to the attached figures, wherein like structures are referred to by like numerals throughout the several views.

While the above-identified drawings set forth several preferred embodiments, other embodiments of the present invention are also contemplated, as noted in the discussion. This disclosure presents illustrative embodiments of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENTS

Figure 1:
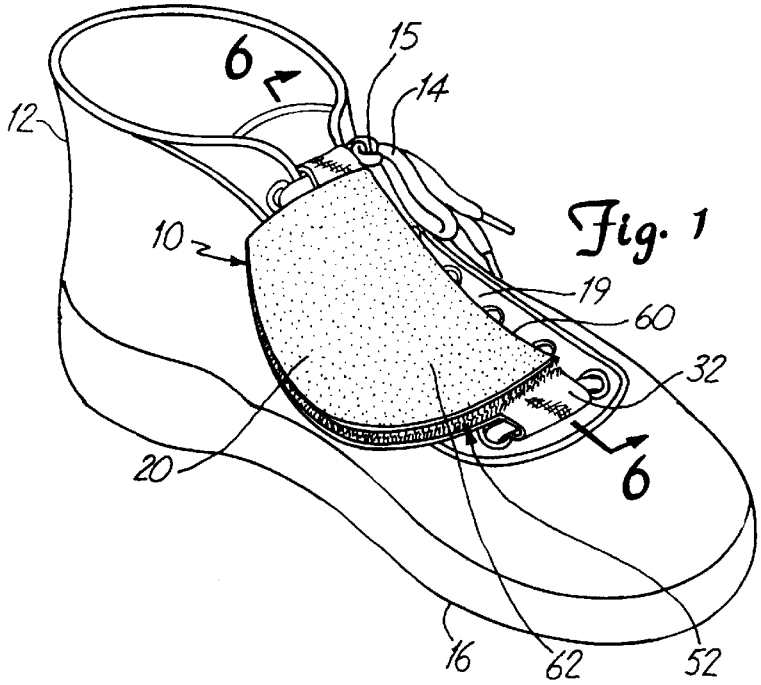
FIG. 1 is a view in perspective of a shoe sole cleaner of the present invention attached to a shoe.
Figure 2:
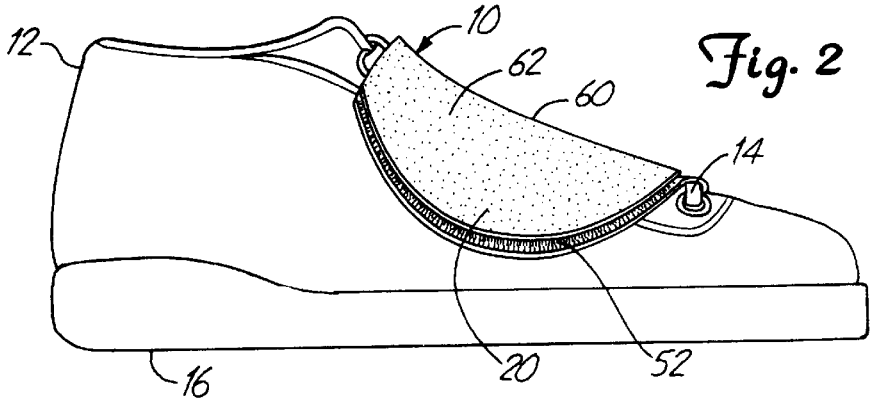
FIG. 2 is a view in side elevation of a shoe sole cleaner of the present invention attached to a shoe.

A shoe sole cleaner of the present invention is illustrated generally at 10 in FIGS. 1 and 2. The shoe sole cleaner 10 is designed for detachable attachment to a shoe 12 through shoelaces 14. The shoe sole cleaner 10 is also designed to attach to any type of laced footwear. In one embodiment FIG. 3), the shoe sole cleaner 10 is a two-part structure including a mounting assembly 26 and a cleaning assembly 28. The mounting assembly 26 secures the shoe sole cleaner 10 to the shoe 12 through the shoelaces 14 and the cleaning assembly 28 detachably attaches to the mounting assembly 26 and the shoe 12 and, when attached, allows a user to clean a sole 16 of the shoe 12 worn on the opposite foot.

The mounting assembly 26 includes a base member 30 and an elongated closure strap 32 extending from the base member 30. The base member 30 includes an outer surface 34, an inner surface 36, a first end 38 and a second end 40. A fixed end 42 of the elongated closure strap 32 extends from the first end 38 of the base member 30. The elongated closure strap 32 also includes an elongate portion 44 and a free end 46. A first part 48 of a hook-and-loop fastener 52 covers substantially the entire outer surface 34 of the base member 30. A complementary part 49 of the hook-and-loop fastener 52 covers the free end 46 of the elongated closure strap 32. The first part 48 and the complementary part 49 of the hook-and-loop fastener 52 permit the detachable attachment of the free end 46 of the elongated closure strap 32 to the outer surface 34 of the base member 30 adjacent the second end 40 of the base member 30.

Figure 4:
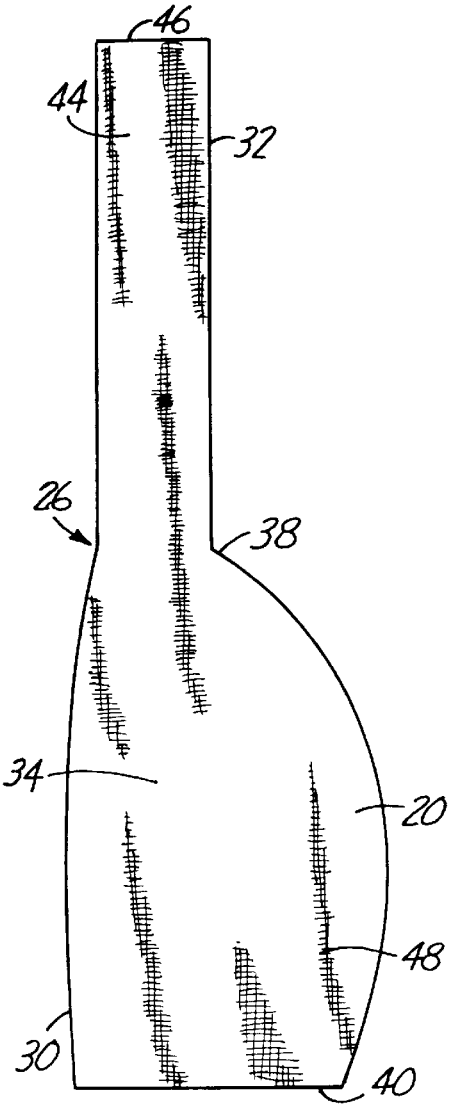
FIG. 4 is a top plan view of a shoe sole cleaner of the present invention.
Figure 5:
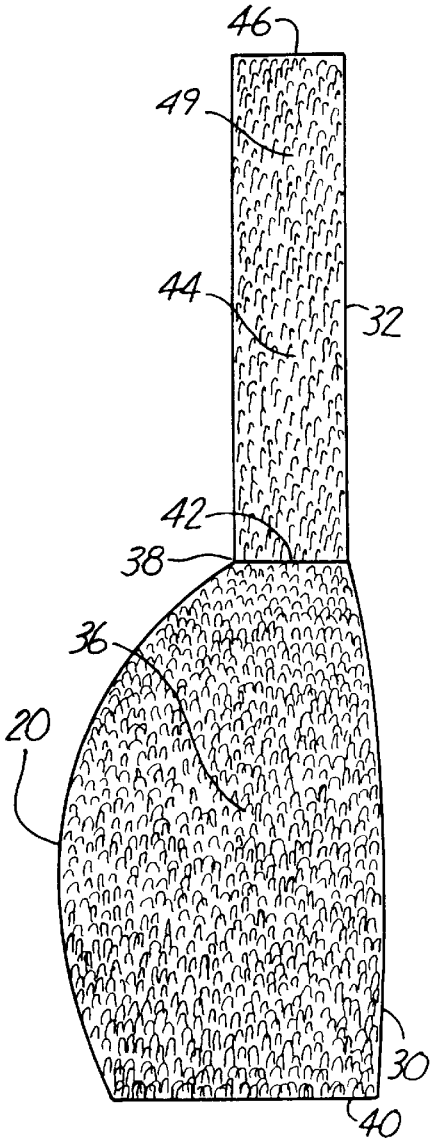
FIG. 5 is a bottom plan view of a shoe sole cleaner of the present invention.

As illustrated in FIGS. 4 and 5, the base member 30 is generally a non-rotting material (e.g., plastic) that stiffens the shoe sole cleaner 10. The base member 30 provides the shoe sole cleaner 10 with sufficient rigidity to withstand the force of the shoe sole 16 swiping across the shoe sole cleaner 10.

The cleaning assembly 28 is preferably removable from the mounting assembly 26, and includes a shoe sole cleaning sheet 60 having an outer surface 62 and inner surface 64. As illustrated in FIGS. 1 and 2, the outer surface 62 of the shoe sole cleaning sheet 60 is generally a thin, pliable, durable and lightweight material with sufficient texture to provide effective cleaning of foreign residue on the sole 16 of the shoe 12. The outer surface 62 of the shoe sole cleaning sheet 60 absorbs slight and extraneous wetness to more efficiently clean the residue on the shoe sole 16. The outer surface 62 of the shoe sole cleaning sheet 60 also displays resiliency as it stretches to withstand the force of the sole 16 of the shoe 12 rubbing over the outer surface 62. The outer surface 62 of the shoe sole cleaning sheet 60 is capable of bearing indicia of varying colors and distinctive design aspects and may be imprinted with a design or pattern (e.g., school, amateur, or professional sports colors and/or logos, or advertising).

In a preferred embodiment, the outer surface 62 of the shoe sole cleaning sheet 60 is a textured fabric material (e.g., cotton chamois cloth or terry cloth) that simulates the soft, pliable leather commonly used in athletic footwear. Specifically, the textured fabric material of the shoe sole cleaning sheet 60 is wear-resistant, adaptable and supple. The textured fabric material of the shoe sole cleaning sheet 60 is strong enough to withstand the stretching that occurs due to the force of the shoe sole 16 coming in contact with the outer surface 62 of the shoe sole cleaning sheet 60. The outer surface 62 of the shoe sole cleaning sheet 60 is water-absorbent, providing effective cleaning of the residue on the shoe sole 16.

A second complementary part 50 of the hook-and-loop fastener 52 is secured to and substantially covers the inner surface 64 of the shoe sole cleaning sheet 60. The second complementary part 50 of the hook-and-loop fastener 52 may engage the inner surface 64 of the shoe sole cleaning sheet 60 by tape, glue, adhesives, laminates, rivets or any other appropriate mechanical fastener. The second complementary part 50 of the hook-and-loop fastener 52 engages the first part 48 on the outer surface 34 of the base member 30 to secure the shoe sole cleaning sheet 60 to the base member 30. The shoe sole cleaning sheet 60 is designed to be removed when dirty or soiled and can be easily replaced.

The application of the invention is illustrated herein with the shoe sole cleaner 10 configured to have an enlarged instep portion 20, since that is the direction that the swiping will be conducted by the user. Both the base member 30 and the cleaning sheet 60 feature the enlarged instep portion 20, as the shape of the cleaning sheet 60 is substantially identical to the shape of the base member. The enlarged instep portion 20 of the shoe sole cleaner 10 is wider toward the center portion of the shoe sole cleaner 10 on an instep portion 18 of the shoe 12. This design provides maximum cleaning surface area toward the portion of the shoe sole cleaner 10 that contacts the sole 16 of the shoe 12 as the user swipes the opposing shoe across the shoe sole cleaner 10. Additionally, the enlarged instep design permits the shoe sole cleaner 10 to remain unimposing on the shoe 12 (with a low profile). However, the invention is equally applicable to other shapes of the shoe sole cleaner 10, and the discussion of the enlarged instep shape is intended to be illustrative, not limiting, in this regard. In alternative embodiments, the shoe sole cleaner 10 is oval shaped to provide maximum cleaning surface area toward the center of the shoe sole cleaner 10, or rectangular shaped.

Figure 3:
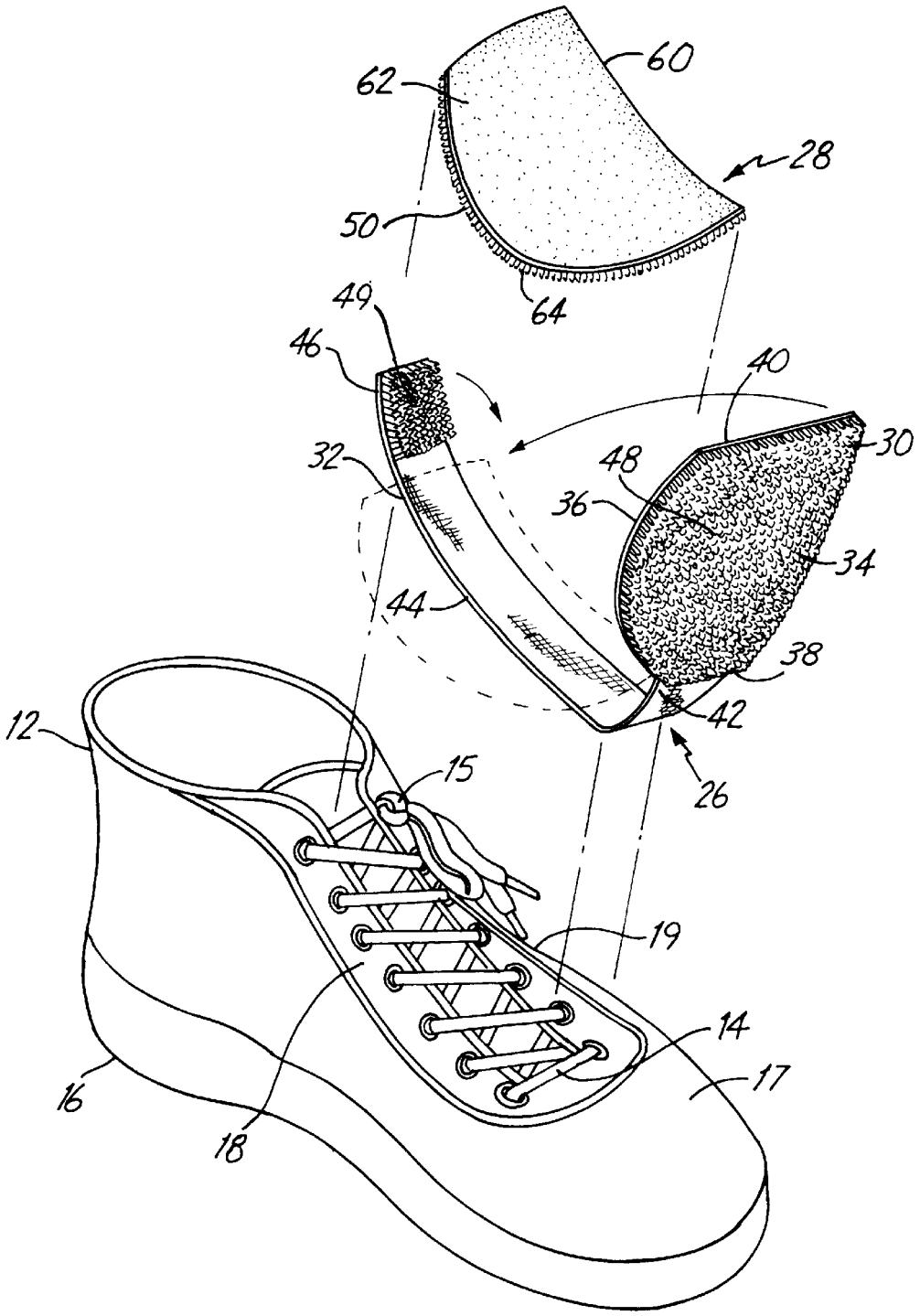
FIG. 3 is an exploded perspective view of a shoe sole cleaner of the present invention and a shoe.

FIG. 3 illustrates how the shoe sole cleaner 10 attaches to the shoe 12. First, the user loosens the shoelaces 14 on the shoe 12 and works the elongated closure strap 32 under at least a portion of the shoelaces 14. Preferably, the elongated closure strap 32 is secured under all of the shoelaces 14 (from toe to ankle) of the shoe 12. After securing the elongated closure strap 32 under the shoelaces 14, the user ties the shoelaces 14 in a knot 15 on an outer side 19 of the shoe 12 to avoid shoelace interference with the shoe sole cleaner 10. The base member 30 is then placed in conformity with the shoelaces 14 of the shoe 12. After base member 30 conforms to the profile of the shoe 12, the free end 46 of the elongated closure strap 32 is secured to the base member 30. The first part 48 of a hook-and-loop fastener 52 that covers substantially the entire outer surface 34 of the base member 30 contacts the complementary part 49 of the hook-and-loop fastener 52 that covers the free end 46 of the elongated closure strap 32. The complementary part 49 of the hook-and-loop fastener 52 actually engages the shoelaces 14, helping secure the shoe sole cleaner 10 to the shoe 12.

After the mounting assembly 26 secures the base member 30 to the shoe 12, the cleaning assembly 28 is secured to the mounting assembly 26. The user places the inner surface 64 of the shoe sole cleaning sheet 60 in contact with the outer surface 34 of the base member 30. The first part 48 of the hook-and-loop fastener 52 attached to the outer surface 34 of the base member 30 engages the second complementary part 50 of the hook-and-loop fastener 52 attached to the inner surface 64 of the shoe sole cleaning sheet 60. This permits detachable attachment of the shoe sole cleaning sheet 60 to the base member 30.

The hook-and-loop structure permits detachable attachment of the free end 46 of the elongated closure strap 32 to the outer surface 34 of base member 30 adjacent the second end 40 of the base member 30. This detachable engagement permits the user to remove the shoe sole cleaners 10 from one pair of shoes and reinstall the shoe sole cleaners 10 on a completely different pair of shoes. Because the shoe sole cleaners are removable from the shoes 12 and are fully adjustable to fit any laced pair of shoes 12, the user only needs one pair of shoe sole cleaners 10 for all of the user's laced footwear.

In a preferred embodiment, the first part of the hook-and-loop fastener is the loop portion which presents for engagement a surface having multiple exposed fiber loops. The complementary part of the hook-and-loop fastener preferably includes a plurality of hooking stems formed and disposed to engage the fiber loops of the loop portion of the first part, in typical hook-and-loop fastener fashion. As used herein, "hook-and-loop fastener" means any two-part mechanical fastener which operates on contact or pressure to mechanically engage two components. A typical example of a hook-and-loop fastener using fibers and hooking stems is the Velcro®-type mechanical fastener. Other suitable mechanical fastener assemblies will also suffice, as discussed below, so long as they achieve the characteristics of repeated mechanical engageability and separability without damage to the parts being joined and separated, and provide sufficient engagement force.

Figure 6:
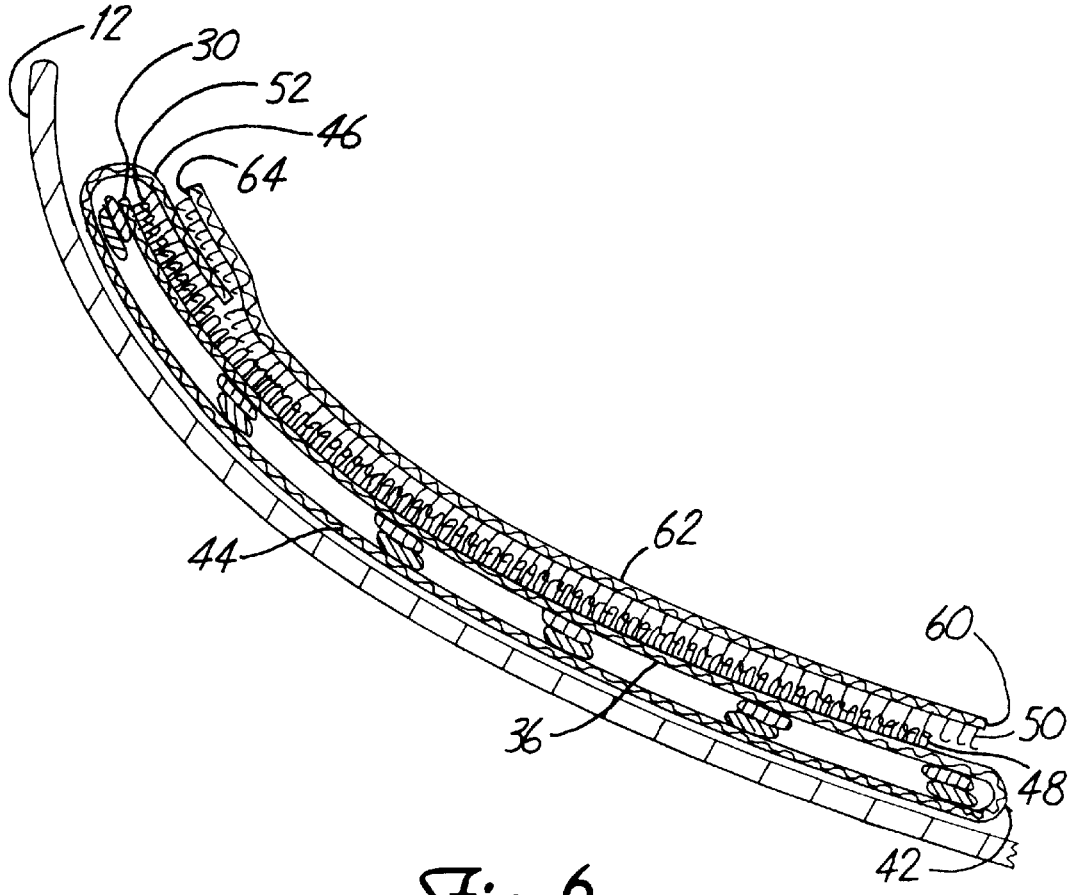
FIG. 6 is a sectional view of a shoe sole cleaner of the present invention as taken along a line 6—6 in FIG. 1.

FIG. 6 illustrates in detail the hook-and-loop mechanical fastener engagement relationship. The first part 48 of the hook-and-loop fastener 52 has a plurality of exposed fiber loops, some of which are engaged by the complementary parts 49 and 50 of the hook-and-loop fastener 52. The complementary parts of the hook-and-loop fastener in turn are formed as generally planar substrates having a plurality of hooking stems projecting outwardly therefrom. Preferably, the hooking stems are formed integrally with the substrate. Each hooking stem includes means for hooking an opposed surface (such as a loop material), which is shown as a head on the end of each hooking stem. The head may be any suitable shape or configuration to serve as a means to snag one or more of the fiber loops for engagement therewith upon contact. Suitable hooking structures and methods of their formation are disclosed in Melbye et al. U.S. Pat. No. 5,077,870, Chesley U.S. Pat. No. 5,505,747, Nestegard U.S. Pat. No. 4,894,060, and Thomas et al. U.S. Pat. No. 5,058,247, which are all incorporated by reference herein.

The degree of adhesion achieved by the hook-and-loop fastener 52 is a function of many variables. Some of these include the density of the hook-and-loop components, their relative sizes (e.g., height of loops and length of hooking stems) and the weight of the shoe sole cleaner 10 itself. Preferably, a low profile hook-and-loop fastener structure is desired. The engaging force can be increased by increasing the relative surface area of the hook-and-loop fastener 52 (e.g., by increasing the size of the hooks on the second complementary part 50 on the inner surface 64 of the shoe sole cleaning sheet 60 and the size of the hooks on the complementary part 49 on the free end 46 of the elongated closure strap 32) or by other means such as changing densities of the hooking stems or head sizes, etc.

A further advantage in using a hook-and-loop fastener structure is that the loop material provides a cushioning layer for the user's foot as the user swipes one shoe sole 16 over the shoe sole cleaner 10. The use of a hook-and-loop fastener 52 allows some give laterally (without sacrificing engagement strength) to facilitate effective cleaning of shoe sole 16. While the orientation disclosed above has the loop part of the hook-and-loop fastener 52 on the outer surface 34 of the base member and the hook part of the hook-and-loop fastener 52 on the inner surface 64 of the shoe sole cleaning sheet 60 and the free end 46 of the elongated closure strap 32, that orientation may be reversed.

In the context of this disclosure, the term "hook-and-loop fastener" refers not only the hooking stem/fiber loop hook-and-loop materials (which are often referred to as Velcro®-type hook-and-loop material), but also to other intermeshing two-part mechanical fasteners. FIG. 6 illustrates but one example of such opposed mechanical fasteners. Other examples are known by commercial names such as "Scotchmate" and "Dual Lock," both available from Minnesota Mining and Manufacturing Company, Saint Paul, Minn. One advantage of using some types of mechanical fasteners instead of the Velcro®-type mechanical fastener is that engagement is not effective until some pressure is applied between opposing fastener parts. The shoe sole cleaning sheet 60 is then affirmatively secured to the base member 30 by applying pressure to the fastener components to "snap" them together. Again, attachment ease (engagement by force) and holding power (disengagement strength) may be altered through the choice of stem density. A further advantage from this type of mechanical fastener for users is the tactile feel and audible "click" or "snap" which can be heard when the fasteners interengage upon the application of such pressure.

Figure 7:
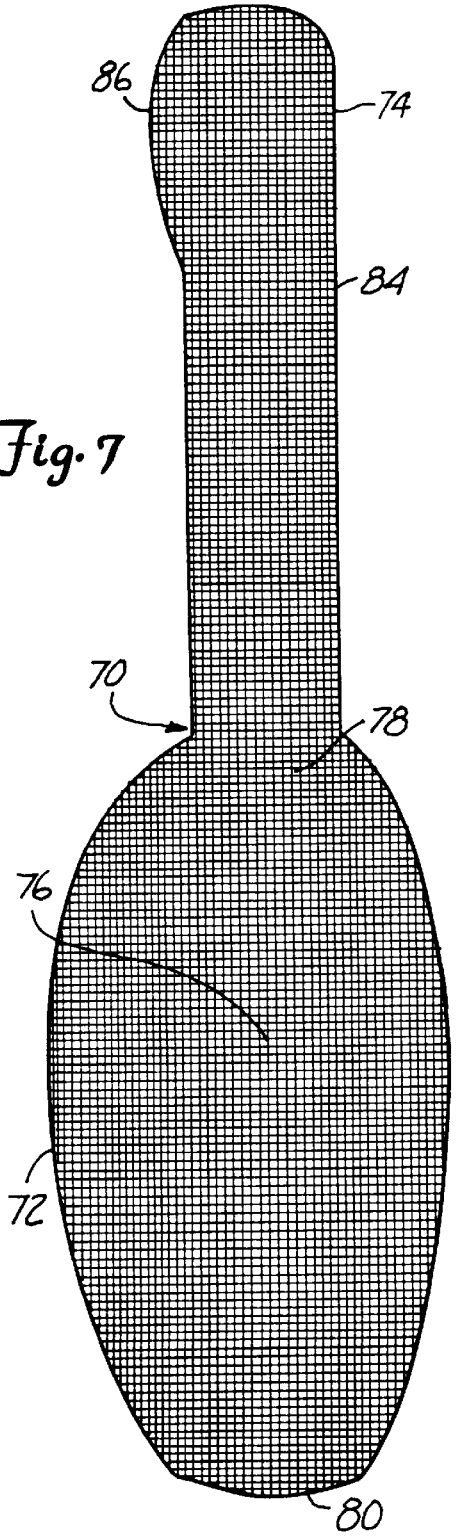
FIG. 7 is a top plan view of an alternative embodiment of a shoe sole cleaner of the present invention.
Figure 8:
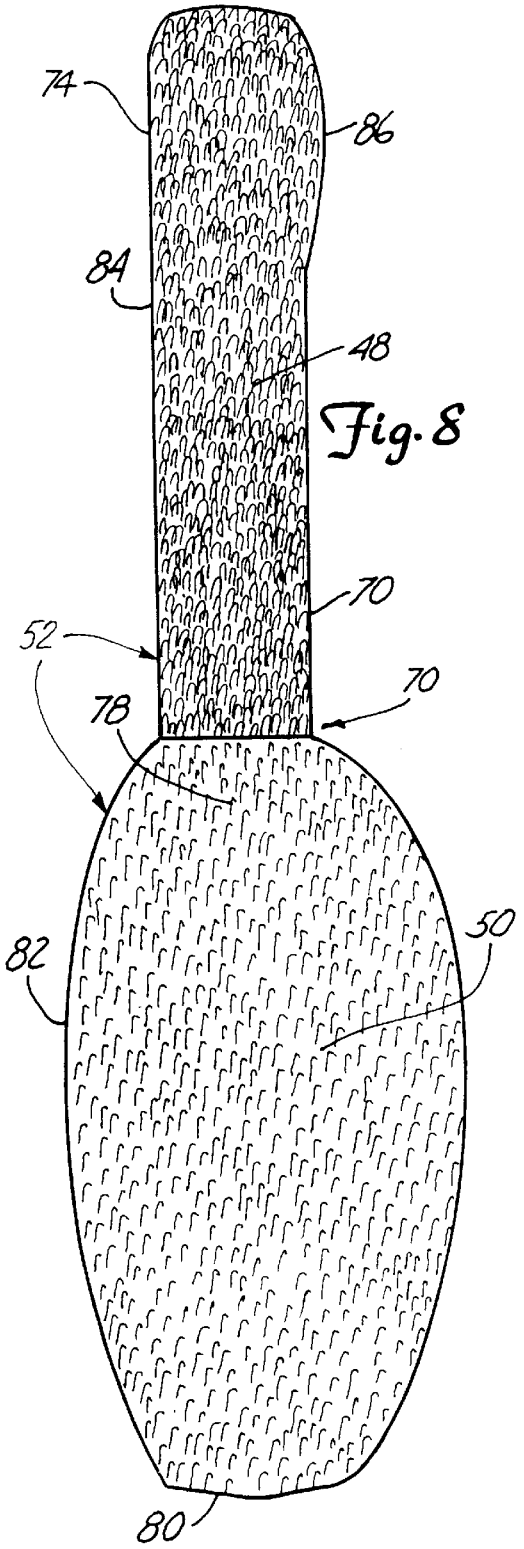
FIG. 8 is a bottom plan view of an alternative embodiment of a shoe a shoe sole cleaner of the present invention.
Figure 9:
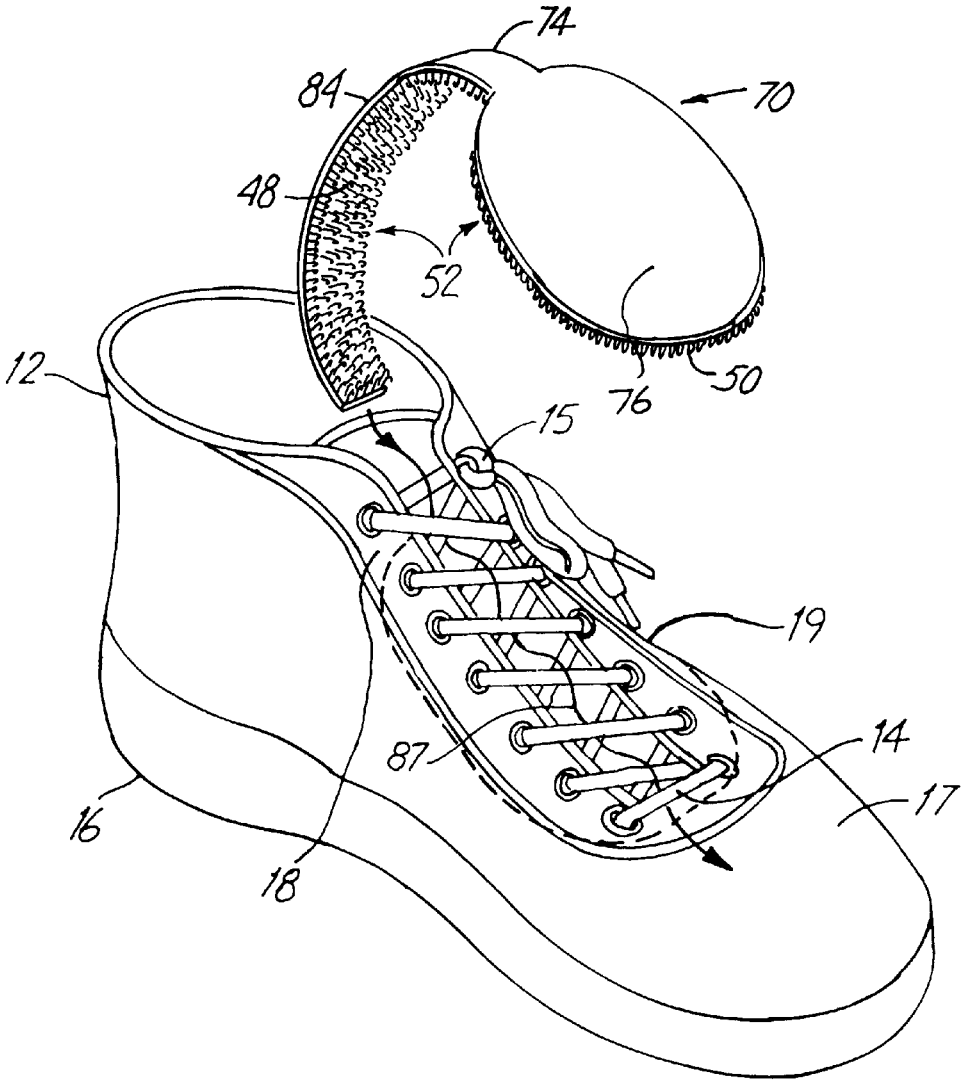
FIG. 9 is an exploded perspective view of an alternative embodiment of a shoe sole cleaner of the present invention and a shoe.

Another preferred embodiment of the present invention is shown in FIGS. 7–9. In this embodiment, the shoe sole cleaner 70 is a one-piece component that attaches directly to the shoelaces 14 of the shoe 12. Separate one-piece shoe sole cleaners 70 are provided for the shoe of the left foot and the shoe of the right foot. The one-piece shoe sole cleaner 70 includes a cleaning assembly 72 and a mounting assembly 74. The mounting assembly 74 secures the one-piece shoe sole cleaner 70 to the shoe 12 through the shoelaces 14, and the cleaning assembly 72 allows a user to clean the sole 16 of the shoe 12 worn on the opposite foot.

As best shown in FIG. 7, the cleaning assembly 72 includes a cleaning surface 76 having a first end 78 and a second end 80. The shape of the cleaning surface 76 provides effective shoe sole cleaning because the cleaning surface 76 maintains contact with the shoe sole 16 as the shoe sole 16 is dragged across the cleaning surface 76. The cleaning surface 76 is generally a thin, pliable, durable and lightweight material with sufficient texture to provide effective cleaning of foreign residue on the sole 16 of the shoe 12. The cleaning surface 76 absorbs slight and extraneous wetness to more efficiently clean the residue on the shoe sole 16 and displays resiliency as the cleaning surface 76 is deformed or stretched under the force of the sole 16 of the shoe 12 rubbing against the cleaning surface 76. The cleaning surface 76 is capable of bearing indicia of varying colors and distinctive design aspects and may be imprinted with a design or pattern (e.g., school, amateur, or professional sports colors and/or logos, or advertising).

FIG. 8 shows that the mounting assembly 74 includes a contact strap 84 covered in the first part 48 of the hook-and-loop fastener 52. The mounting assembly 74 also includes the complementary part 50 of the hook-and-loop fastener 52 attached to an underside 82 of the cleaning surface 76. The contact strap 84 extends from the first end 78 of the cleaning surface 76 and features a bowed portion 86 for gripping by the user.

FIG. 9 illustrates the attachment of the one-piece shoe sole cleaner 70 to the shoe 12. The user works the contact strap 84 under at least a portion of the shoelaces 14, preferably after the shoelaces 14 have been tied in a knot 15. The bowed portion 86 of the contact strap 84 is first placed under the shoelace closest to the ankle. Preferably, the contact strap 84 is secured under every other shoelace 14, as indicated by placement arrow 87 in FIG. 9. Once the contact strap 84 is secured under the shoelaces 14, the user positions the cleaning surface 76 in substantial conformity with the shoelaces 14, allowing the first part 48 of the hook-and-loop fastener 52 covering the contact strap 84 to engage the complementary part 50 of the hook-and-loop fastener 52 covering the underside 82 of the cleaning surface 76. The engagement of the first 48 and second complementary 50 parts of the hook-and-loop fastener 52 ensures that the one-piece shoe sole cleaner 70 is attached to the shoe 12. To remove the one-piece shoe sole cleaner 70 from the shoe 12, the user simply disengages the first 48 and the complementary 50 parts of the hook-and-loop fastener 52 and extracts the one-piece shoe sole cleaner 70 from the shoe 12.

Securing the contact strap 84 under every other shoelace (instead of every shoelace) permits sufficient surface area of the contact strap 84 covered in the first part 48 of the hook-and-loop fastener 52 to engage the complementary part 50 of the hook-and-loop fastener 52 covering the underside 82 of the cleaning surface 76. Securing the contact strap 84 under at least every other shoelace also ensures that the one-piece shoe sole cleaner 70 is solidly attached to the shoe 12.

In this embodiment, a separable shoe sole cleaning sheet 60 is not necessary as the cleaning surface 76 of the one-piece shoe sole cleaner 70 is not separable from the shoe sole cleaner 70. When the cleaning surface 76 becomes dirty or otherwise ineffective, the entire one-piece shoe sole cleaner 70 is replaced. This embodiment of the invention is thus completely disposable or, if washable, reusable.

Figure 10:
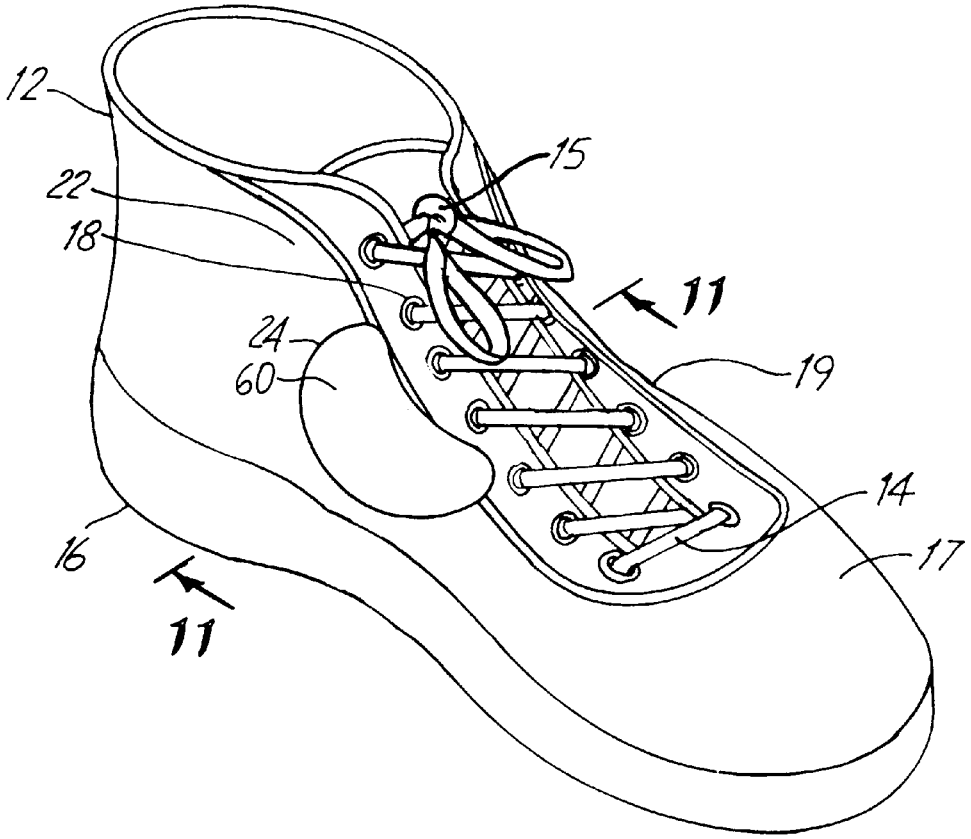
FIG. 10 is a view in perspective of another alternative embodiment of a shoe sole cleaner of the present invention.

FIG. 10 illustrates an alternative embodiment of the present invention in which the shoe sole cleaner 10 is not a separate component from a shoe, but is (at least in part) an integral part of the shoe itself During manufacture of the shoe, the shoe sole cleaner 10 may be built-in to the shoe (e.g., alongside the shoelaces in the instep portion 18 or a forefoot portion 17 of the shoe 12). Integrating the shoe sole cleaner 10 in the shoe itself ensures a virtually unimposing (low profile) cleaner because the shoe sole cleaner 10 is a permanent part to the shoe 12. This embodiment does not require the mounting assembly 26 featuring the elongated strap 32 to secure the shoe sole cleaner 10 to the shoe 12. Instead, the base member 30 is permanently attached to the shoe 12 in a cavity 24 in an upper 22 of the shoe 12.

Figure 11:
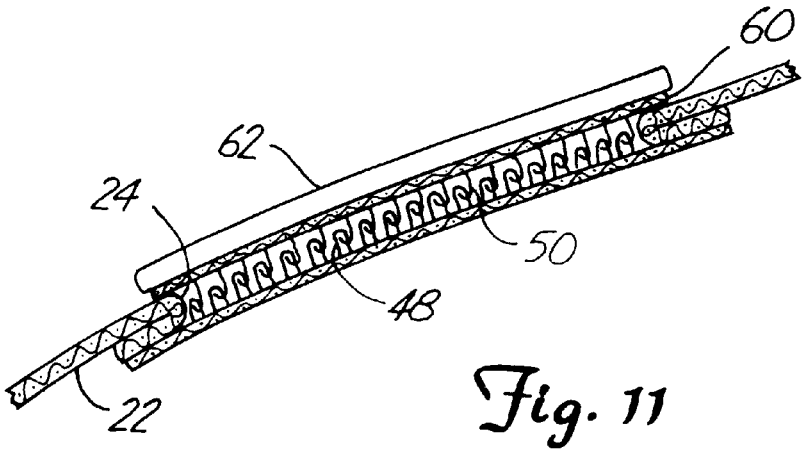
FIG. 11 is a sectional view of another alternative embodiment of the shoe sole cleaner of the present invention as taken along a line 11—11 in FIG. 10.

In this alternative embodiment, the base member 30 may be in the same shape as the base member 30 for the separate shoe sole cleaner 10 attachment or the base member 30 may be in various other shapes (e.g., oval, circle, rectangle, etc.). The outer surface 34 of the base member 30 is still covered by a first part 48 of the hook-and-loop fastener 52 for detachable engagement with the inner surface 64 of the shoe sole cleaning sheet 60. Thus, the shoe sole cleaning sheet 60 is removable from the base member 30 in the cavity 24, permitting simple replacement of the shoe sole cleaning sheet 60 when the outer surface 62 is soiled or dirty. FIG. 11 illustrates in detail the hook-and-loop fastener engagement relationship for the alternative embodiment of the present invention where the shoe sole cleaner 10 is integral to the shoe 12.

Figure 12:
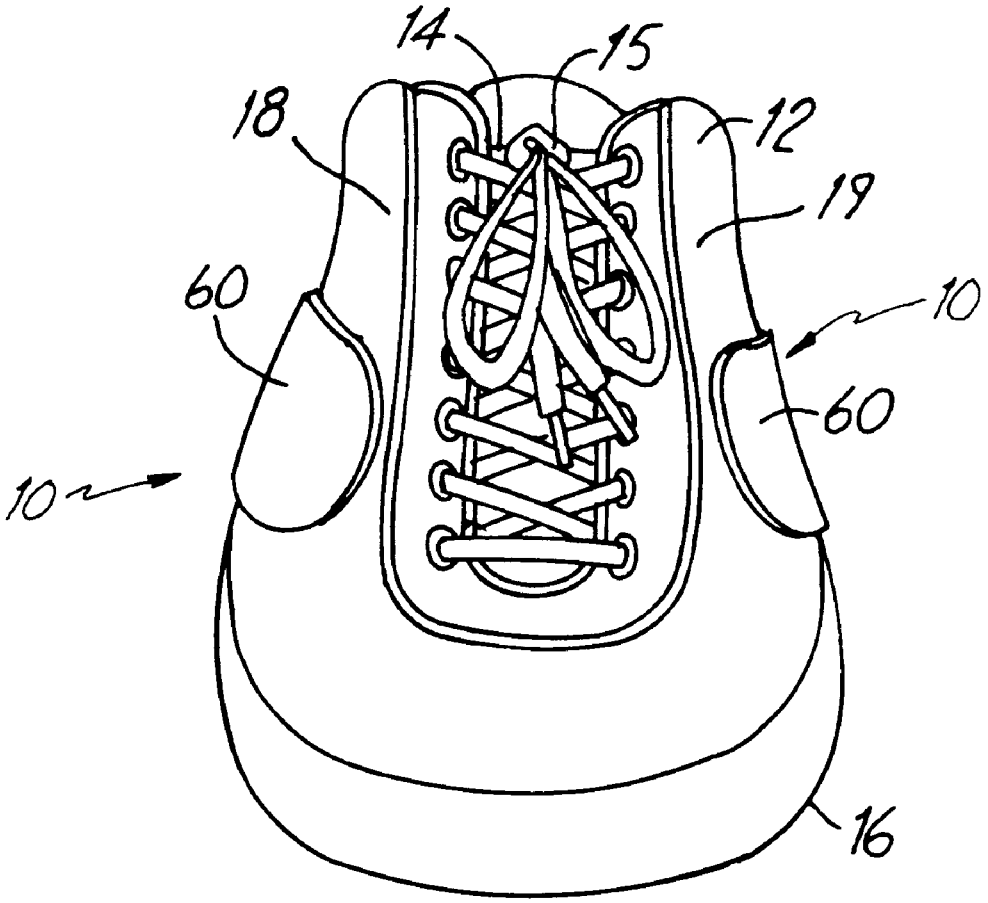
FIG. 12 is a front view of another alternative embodiment of a shoe sole cleaner of the present invention.

FIG. 12 illustrates another alternative embodiment of the present invention in which two shoe sole cleaners 10 are built into the shoe 12. One shoe sole cleaner 10 is integral to the instep side 18 of the shoe 12 and the other shoe sole cleaner 10 is integral to the outer side 19 of the shoe 12. In this embodiment, the shoe sole cleaning sheets 60 are provided which substantially conform to the profile of the shoe 12 and are preferably removable from the shoe 12 for simple replacement. The present invention is equally applicable to any number of shoe sole cleaners 10 integral to the shoe 12, and the discussion of one or two shoe sole cleaners 10 is intended to be illustrative, not limiting, in this regard. In alternative embodiments, three or more shoe sole cleaners 10 are integral to the shoe 12 and located on the forefoot 17, the instep side 18 or the outer side 19 of the shoe 12. A single shoe sole cleaner 10 can be located at any one of these locations and a pair of shoe sole cleaners 10 can be located at any combination of these locations on the shoe 12.

Figure 13:
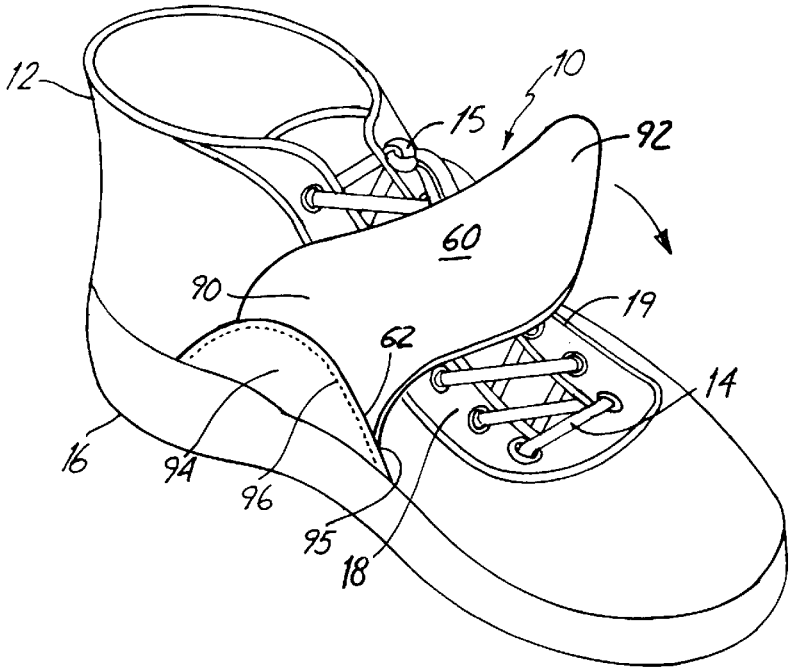
FIG. 13 is a view in perspective of another alternative embodiment of a shoe sole cleaner of the present invention.
Figure 14:
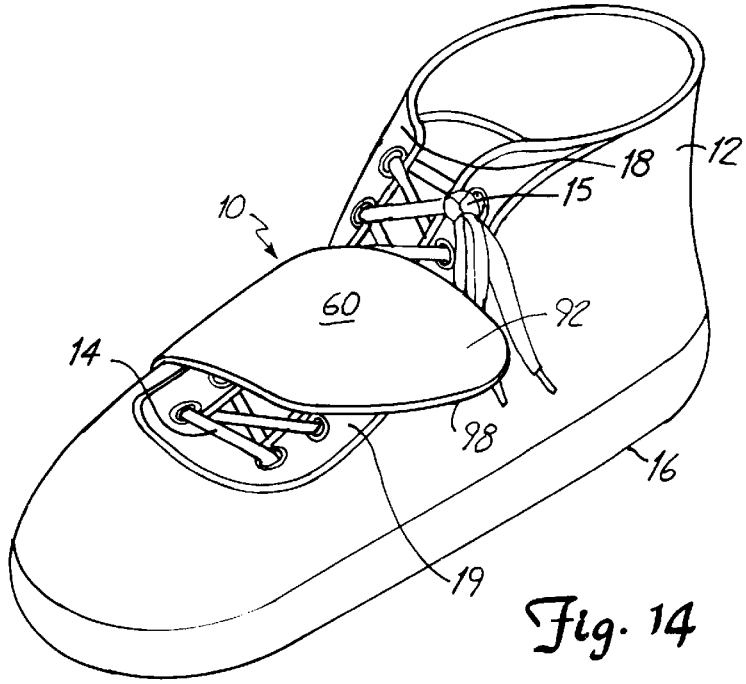
FIG. 14 is a view in perspective of the alternative embodiment of a shoe sole cleaner of the present invention shown in FIG. 13.
Figures 15, 16:
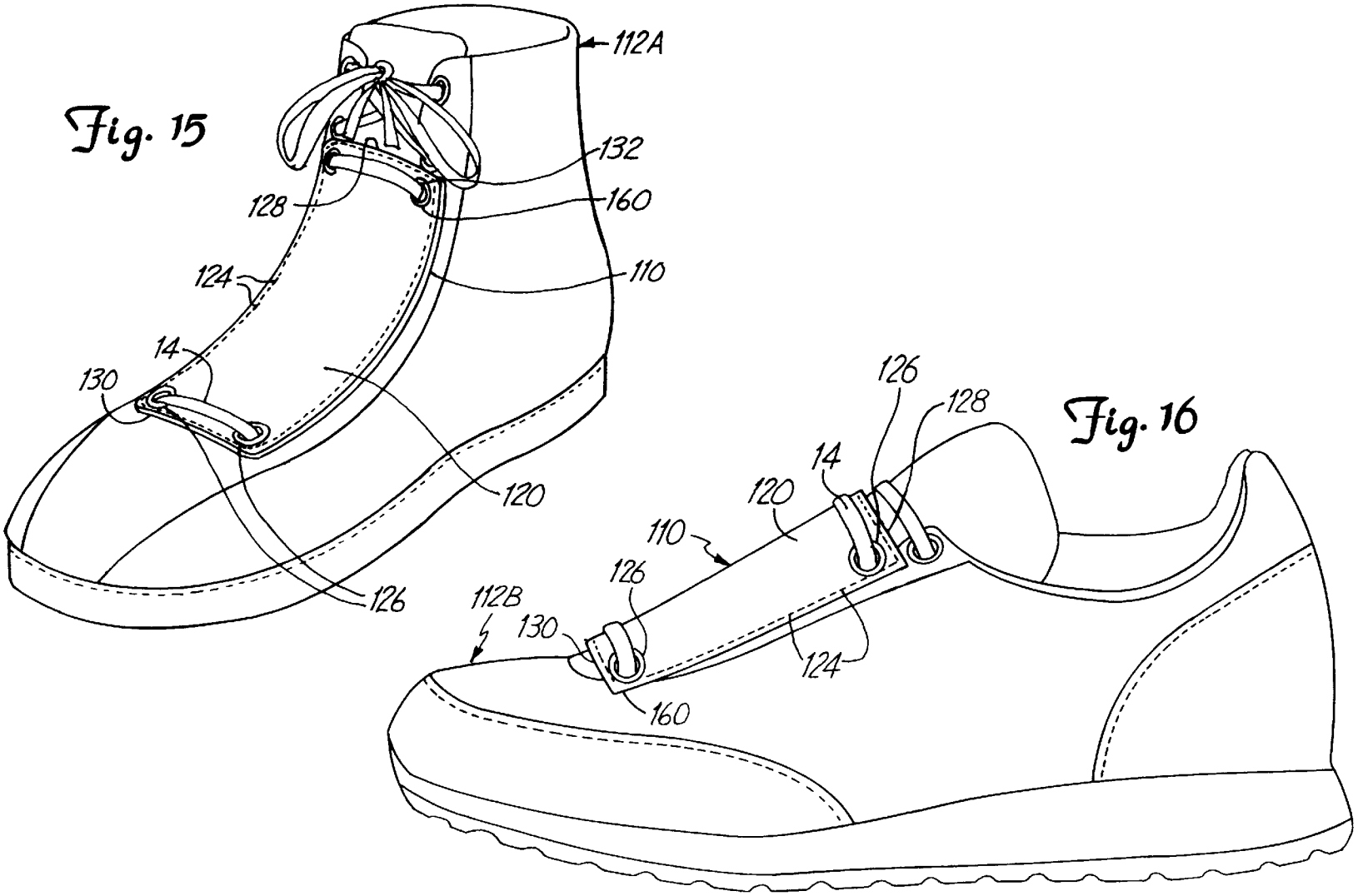
FIG. 15 is a view in perspective of another alternative embodiment of a shoe sole cleaner of the present invention attached to a shoe.
FIG. 16 is a view in side elevation of another alternative embodiment of a shoe sole cleaner of the present invention attached to a different type of shoe than FIG. 15.

FIGS. 13 and 14 illustrate another embodiment of the shoe sole cleaner of the present invention. In this embodiment, the shoe sole cleaner 10 is permanently attached to the shoe 12. A fixed end 90 of a shoe sole cleaning sheet 60 is permanently attached to the instep side 18 of the shoe 12 by a securing member 94. The shoe sole cleaning sheet 60 engages the securing member 94 by a securing seam 96 that mechanically fastens the outer surface 62 of the shoe sole cleaning sheet 60 to an inner surface 95 of the securing member 94. The securing seam 96 maintains a durable engagement between the shoe sole cleaning sheet 60 and the securing member 94, even in moist conditions. The shoe sole cleaning sheet 60 may engage the securing member 94 by tape, glue, hook-and-loop fasteners, adhesives, laminates, rivets or any other appropriate mechanical fastener.

A free end 92 of the shoe sole cleaning sheet 60 is pulled across the shoelaces 14 to substantially conform the shoe sole cleaning sheet 60 to the profile of the shoe 12, preferably after the shoelaces 14 of the shoe 12 are tied. The free end 92 of the shoe sole cleaning sheet 60 engages a fastening member 98 on the outer side 19 of the shoe 12 to mechanically fasten the free end 92 of the shoe sole cleaning sheet 60 to the shoe 12. The fastening member 98 maintains a durable engagement with the free end 92 of the shoe sole cleaning sheet 60, even in moist conditions. The free end 92 of the shoe sole cleaning sheet 60 may engage the fastening member 98 by tape, glue, hook-and-loop fasteners, adhesives, laminates or any other appropriate mechanical fastener. The free end 92 of the shoe sole cleaning sheet 60 releasably attaches to the fastening member 98, allowing the user to adjust the tightness of the shoe sole cleaning sheet 60 across the shoelaces 14. As such, this embodiment of the shoe sole cleaner 10 provides additional support to the user's foot.

Another embodiment of the shoe sole cleaner of the present invention is illustrated generally at 110 in FIG. 1 5. The shoe sole cleaner 110 is provided for use with different types of shoes 112A (FIG. 15) and 112B (FIG. 16) with shoelaces 14. As shown in FIGS. 15–18, the shoe sole cleaner 110 is, in one embodiment, generally rectangular and includes a fabric layer 120, a support layer 122, a securing seam 124, a mounting assembly 126, an upper end 128, a lower end 130 and a plurality of circular holes 132.

Figure 18:
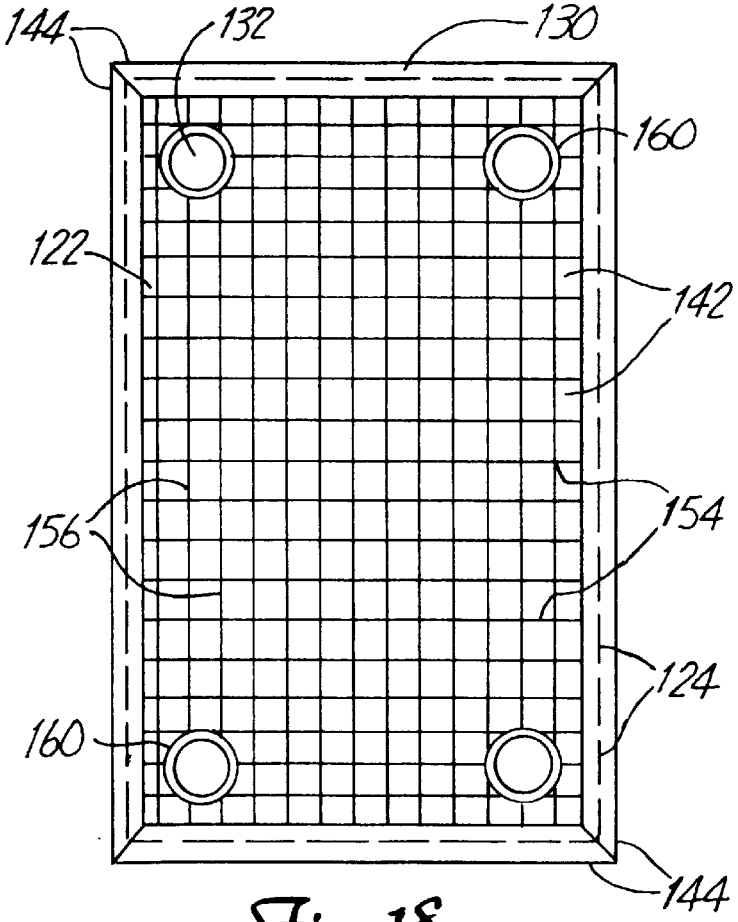
FIG. 18 is a bottom plan view of an alternative embodiment of a shoe sole cleaner of the present invention.
Figure 19:
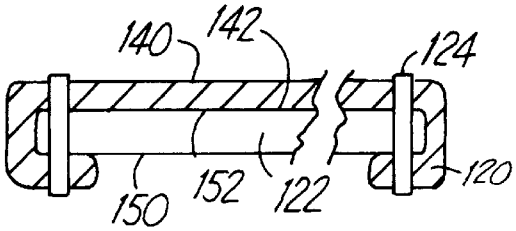
FIG. 19 is a sectional view of an alternative embodiment of a shoe sole cleaner of the present invention as taken along a line 19—19 in FIG. 17.
Figure 20:
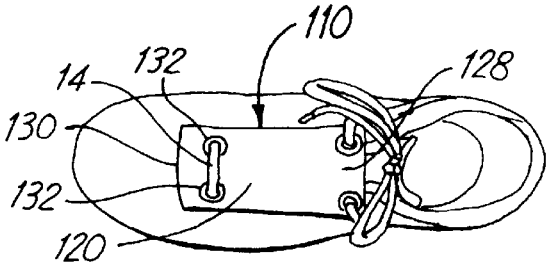
FIG. 20 is a top plan view of another alternative embodiment of a shoe sole cleaner of the present invention attached to a shoe.

The fabric layer 120 includes an outer surface 140, an inner surface 142, and securing flaps 144. As seen in FIGS. 18 and 19, the support layer 122 includes an outer surface 150, an inner surface 152, a first support member 154, and a second support member 156. The support layer 122 engages the fabric layer 120 by the securing seam 124. The mounting assembly 126 includes a plurality of eyelets 160.

Figure 21:
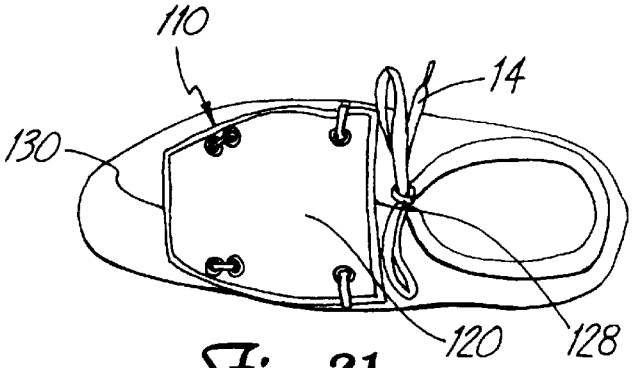
FIG. 21 is a top plan view of another alternative embodiment of a shoe sole cleaner of the present invention attached to a shoe.

The application of the invention is illustrated herein via a typical rectangular shape of the shoe sole cleaner 110. However, the invention is equally applicable to other shapes of the shoe sole cleaner 110, and the discussion of the generally rectangular shape is intended to be illustrative, not limiting, in this regard. In another alternative embodiment (FIG. 21), the shoe sole cleaner 110 is wider toward the upper end 128 than the lower end 130. This design provides maximum cleaning surface area toward the upper end 128 of the shoe sole cleaner 110, while the lower end 130 remains unimposing on a shoe. In another alternative embodiment, the shoe sole cleaner 110 is oval shaped to provide maximum cleaning surface area toward the center of the shoe sole cleaner 110.

Figure 17:
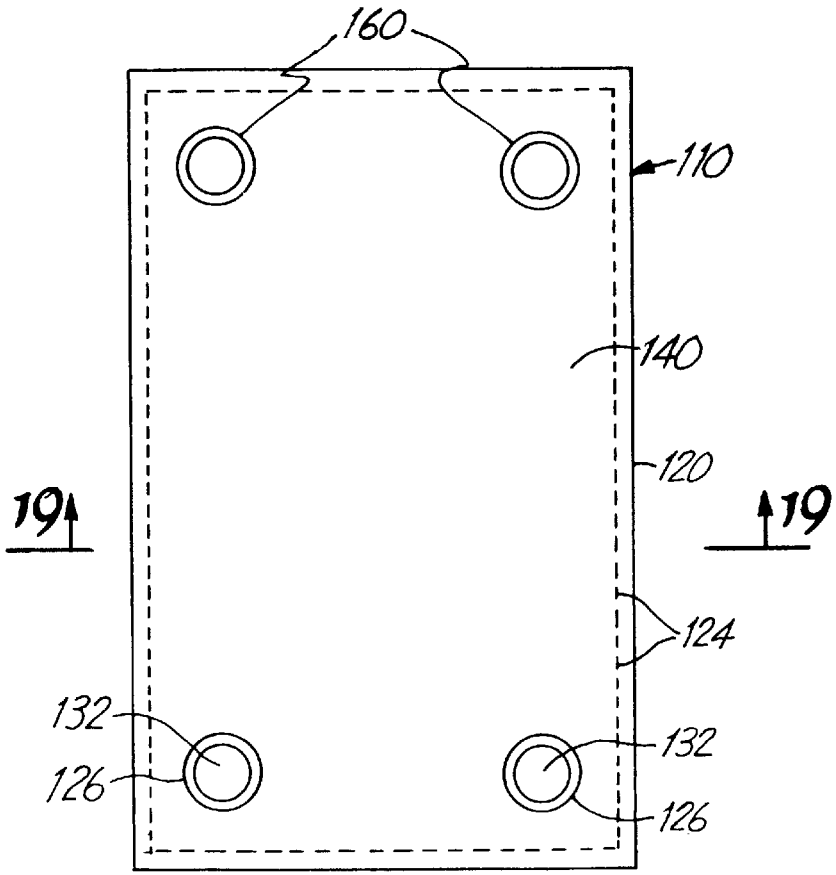
FIG. 17 is a top plan view of an alternative embodiment of a shoe sole cleaner of the present invention.

As illustrated in FIG. 17, the fabric layer 120 is generally a pliable, durable and lightweight material that provides effective cleaning of foreign residue on the sole of shoes. The outer surface 140 of the fabric layer 120 absorbs slight and extraneous wetness to more efficiently clean the residue on shoe soles. The fabric layer 120 also displays resiliency as it stretches to withstand the force of the sole of a shoe rubbing over the outer surface 140. The fabric layer 120 may be imprinted with a design or pattern (e.g., school, amateur, or professional sports colors and/or logos, or advertising).

In a preferred embodiment, the fabric layer 120 is a cotton chamois cloth that simulates the soft, pliable leather commonly used in athletic footwear. Specifically, the chamois cloth of the fabric layer 120 is wear-resistant, adaptable, and supple. The chamois cloth of the fabric layer 120 is strong enough to withstand the stretching that occurs due to the force of shoe soles coming in contact with the outer surface 140. The outer surface 140 of the fabric layer 120 is water-absorbent, providing effective cleaning of the residue on shoe soles.

As illustrated in FIG. 18, the support layer 122 is generally a non-rotting material (e.g., plastic) that stiffens the shoe sole cleaner 110. The support layer 122 provides the shoe sole cleaner 110 with the rigidity to withstand the force of a shoe sole swiping across the outer surface 140 of the shoe sole cleaner 110. Without the support layer 122, the fabric layer 120 would tend to curl with repeated use, providing ineffective cleaning. In a preferred embodiment, the support layer 122 is a stiff plastic mesh formed from perpendicular first support members 154 and second support members 156.

The support layer 122 engages the fabric layer 120 by the securing seam 124 that mechanically fastens the inner surface 152 of the support layer 122 to the inner surface 142 of the fabric layer 120 (FIG. 19). The securing seam 124 maintains a durable engagement between the support layer 122 and the fabric layer 120 even in wet conditions. The fabric layer 120 may engage the support layer 122 by tape, glue, hook-and-loop fasteners, adhesives, laminates, rivets or any other appropriate mechanical fastener.

In a preferred embodiment, the securing seam 124 engages the fabric layer 120, the support layer 122 and the securing flaps 144 of the fabric layer 120 that are folded over and surround the edges of the support layer 122. The securing seam 124 repeatedly engages these three layers near the perimeter edge of the shoe sole cleaner 110, ensuring a secure engagement of the fabric layer 120 and the support layer 122.

In another alternative embodiment, the edges of the fabric layer 120 are coterminous with the support layer 122 and the fabric layer 120 does not include the securing flaps 144. In this embodiment, an alternative securing seam 124 overlays the edges of the fabric roll 120 and the support layer 122, maintains the engagement of the fabric roll 120 and the support layer 122 and prevents fraying and rolling of the edges of the fabric layer 120. Other alternative embodiments also prevent the fraying and rolling of the edges of the fabric layer 120. For example, the coterminous edges of the fabric layer 120 and the support layer 122 to can be sealed together mechanically or surrounded by a protective edge.

The mounting assembly 126 secures the shoe sole cleaner 110 to a shoe. Although the shoe sole cleaner 110 may be secured to any portion of a shoe, the shoe sole cleaner 110 most effectively cleans shoe soles when secured over the shoelaces 14 of a shoe. However, the shoe sole cleaner 110 also provides effective and efficient shoe sole residue removal when located on the instep or toe area of a shoe. The shoe sole cleaner 110 may be secured to a shoe by a lacing method (through the holes 132), elastic straps, tape, glue, hook-and-loop fasteners, adhesives, laminates, rivets or any other appropriate mechanical fastener.

In a preferred embodiment, a semi-permanent lacing method secures the shoe sole cleaner 110 to a shoe by working the shoelaces 14 through a plurality of circular holes 132 in the shoe sole cleaner 110. The circular holes 132 exist in both the fabric layer 120 and the support layer 122, and are aligned when the fabric layer 122 and the support layer 122 are engaged by the securing seam 124. The commercial eyelets 160 ensure that the shoelaces 14 easily engage the circular holes 132. The circular holes 132 are generally located at known distances from the corners of rectangular the shoe sole cleaner 110. The lacing method secures the shoe sole cleaner 110 to a shoe by working the shoelaces 14 through the eyelets 160 of the circular holes 132 located at the lower end 130, through a multitude of lace holes in the shoe itself, through the eyelets 160 of the circular holes 132 located at the upper end 128 and, finally, through at least one additional lace hole in the shoe itself When the shoe is tied, the shoe sole cleaner 110 becomes securely attached to a shoe and is positioned and ready for use.

Figure 22:
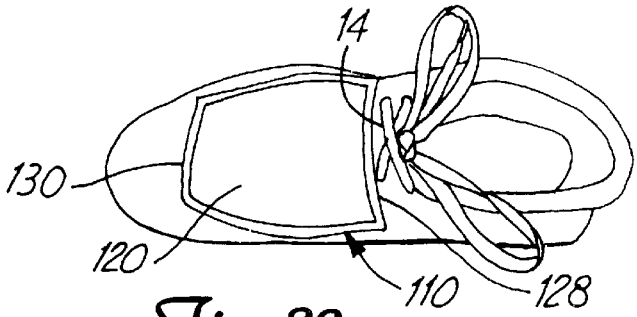
FIG. 22 is a top plan view of another alternative embodiment of a shoe sole cleaner of the present invention attached to a shoe by a hook-and-loop fastener.

In another alternative embodiment, the shoe sole cleaner 110 has numerous holes 132 located at various positions. The user may customize the lacing method and only engage certain holes 132, permitting the shoe sole cleaner 110 to be used with virtually any type of shoe. In another alternative embodiment (FIG. 22), the shoe sole cleaner 110 is attached to a shoe using a hook-and-loop fastener or any similar mechanical interface. A first part of the hook-and-loop fastener is attached to the outer surface 152 of the support layer 122 and a second complementary part of the hook-and-loop fastener is attached to an outside surface of a shoe. The second part of the hook-and-loop fastener engages the first part to the secure shoe sole cleaner 110 to a shoe. A typical example of a hook-and-loop fastener is a Velcro®-type mechanical fastener. Other suitable two-part mechanical fastener assemblies will also suffice, so long as they achieve the characteristic of repeated mechanical engageability and separability without damage to the parts being joined and separated, and provide sufficient engagement force. Other examples of suitable mechanical fasteners are known by commercial names such as "Scotchmate" and "Dual Lock," both available from Minnesota Mining and Manufacturing Company, Saint Paul, Minn.

In another alternative embodiment, the shoe sole cleaner 110 is not a separate component from a shoe, but is an integral part of the shoe itself. During manufacture of the shoe, the shoe sole cleaner may be built-in the shoe (e.g., alongside the shoelaces, or in the instep or in the toe area). Integrating the shoe sole cleaner in the shoe itself ensures a virtually unimposing cleaner because the shoe sole cleaner is permanently attached to the shoe. This embodiment does not require a plurality of circular holes and eyelets, because the shoelaces do not secure the shoe sole cleaner to the shoe. In another alternative embodiment, the shoe sole cleaner has a refillable water storage chamber manufactured into the shoe along with the built-in shoe sole cleaner. The refillable water storage chamber stores a supply of water that is used to moisten the outside surface of the fabric layer, ensuring efficient cleaning of the shoe soles. The refillable water storage chamber works in a manner similar to the air "pump" mechanisms found in athletic footwear and known to those skilled in the art.

The inventive shoe sole cleaner permits a user to clean the soles of his or her shoes at any time or location. While wearing shoes equipped with the shoe sole cleaner of the present invention, the user swipes the sole of one shoe over the shoe on the other foot where shoe sole cleaner is located. By pulling the sole of the shoe across the shoe sole cleaner, foreign residue is removed from the sole of the shoe. Wearing shoe sole cleaners on both shoes permits one shoe to clean the sole of the other. Thus, the inventive shoe sole cleaner provides the user with an instant, portable and effective shoe sole cleaning apparatus, ensuring optimal shoe performance and better traction.

Although the present invention has been described with reference to preferred embodiments, workers skilled in the art will recognize that changes may be made in form and detail without departing from the spirit and scope of the invention. Multiple embodiments of the inventive shoe sole cleaner are disclosed herein, and the features of different embodiments may be combined, as desired, to achieve an effective shoe sole cleaner design.

What is claimed is:

1. A shoe sole cleaner for a pair of shoes, the shoe sole cleaner comprising:

a shoe sole cleaning sheet; and means for replaceably mounting the shoe sole cleaning sheet on one of the pair of shoes in position to be contacted by a bottom of a sole of the other shoe of a pair while both shoes are worn by a user, wherein the mounting means further comprises:

means for securing a first part of a hook-and-loop fastener on the shoe including:

a base member having a first end and a second end, wherein one side of the base member has the first part of the hook-and-loop fastener thereon; and an elongated closure strap having a fixed end attached to the first end of the base member and a free end wherein the free end of the elongated closure strap has a first complementary part of the hook-and-loop fastener thereon for detachable attachment to the first part of the hook-and-loop fastener on the base member; and a second complementary part of a hook-and-loop fastener attached to an inner major surface of the shoe sole cleaning sheet.

2. The shoe sole cleaner of claim 1 wherein the closure strap extends under at least a portion of the shoelace on the shoe and releasably attaches to the base member, mounting the base member to the shoe.

3. The shoe sole cleaner of claim 1 wherein the inner major surface of the shoe sole cleaning sheet is covered by the second complementary part of the hook-and-loop fastener for detachable attachment of the shoe sole cleaning sheet to the outer surface of the base member.

4. The shoe sole cleaner of claim 1 wherein the shoe sole cleaning sheet has an enlarged instep portion to provide greater cleaning area while the user contacts the bottom of the sole of the other shoe with the shoe sole cleaning sheet.

5. The shoe sole cleaner of claim 1 wherein a width of the shoe sole cleaning sheet increases toward an instep portion of the shoe sole cleaning sheet.

6. The shoe sole cleaner of claim 1 wherein an outer major surface of the shoe sole cleaning sheet is a material capable of bearing varying colors and distinctive visual design aspects.

7. The shoe sole cleaner of claim 1, further comprising:

a cavity located in a pre-determined area in an upper of the shoe, wherein the shoe sole cleaning sheet releasably attaches within the cavity.

8. The shoe sole cleaner of claim 7 wherein a portion of the shoe sole cleaner is integral to the shoe and substantially conforms to the profile of the shoe.

9. The shoe sole cleaner of claim 7 wherein the predetermined area is located in an instep portion of the shoe.

10. The shoe sole cleaner of claim 7 wherein the predetermined area is located in a forefoot portion of the shoe.

11. A shoe sole cleaner for use in footwear comprising:

a cavity in an upper of the footwear;

a shoe sole cleaning sheet; and means for replaceably mounting the shoe sole cleaning sheet in the cavity in the upper of the footwear in position to be contacted by a bottom of a sole of the footwear worn on an opposite foot of a user.

12. The shoe sole cleaner of claim 11 wherein the shoe sole cleaning sheet is securable within and removable from the cavity in the upper by relative movement between a perimeters area of the shoe sole cleaning sheet and a mounting means of the upper, such that when the shoe sole cleaning sheet is secured within the cavity in the upper, the perimeters area of the shoe sole cleaning sheet is securely retained in the cavity.

13. A shoe sole cleaner for a pair of shoes, the shoe sole cleaner comprising:

a self-stiffening cleaning sheet having an outer sheet and a stiffener support sheet attached thereto; and a plurality of reinforced holes used to secure the self-stiffening cleaning sheet to a shoe by working at least a portion of a shoelace through the reinforced holes at a lower end of the cleaning sheet, through a multitude of lace holes in the shoe itself, through the reinforced holes at an upper end of the cleaning sheet and through at least one additional lace hole in the shoe itself, so that when the shoelace is tied, the cleaning sheet becomes securely attached to the shoe in position to be contacted by a bottom of a sole of the other shoe of the pair while both shoes are worn by a user.

14. A shoe sole cleaner for a pair of shoes, the shoe sole cleaner comprising:

a self-stiffening cleaning sheet; and a plurality of reinforced holes used to secure the self-stiffening cleaning sheet to a shoe by working at least a portion of a shoelace through the reinforced holes at a lower end of the cleaning sheet, through a multitude of lace holes in the shoe itself through the reinforced holes at an upper end of the cleaning sheet and through at least one additional lace hole in the shoe itself, so that when the shoelace is tied, the cleaning sheet becomes securely attached to the shoe in position to be contacted by a bottom of a sole of the other shoe of the pair while both shoes are worn by a user;

wherein the self-stiffening cleaning sheet has stitching thereon adjacent the perimeter of the sheet that surrounds the reinforced holes.

15. The shoe sole cleaner of claim 14, wherein the plurality of reinforced holes are strengthened by an eyelet that surrounds each reinforced hole and allows the shoelaces to easily engage the plurality of reinforced holes.

16. The shoe sole cleaner of claim 14, wherein the self-stiffening cleaning sheet flexes during impact from the sole of the other shoe.

17. The shoe sole cleaner of claim 14, wherein the plurality of reinforced holes are located adjacent a perimeter edge of the self-stiffening cleaning sheet.

18. The shoe sole cleaner of claim 14, herein the self-stiffening cleaning sheet is a moisture-absorbent material with sufficient surface texture to remove foreign debris from the sole of the other shoe upon contact therewith and could bear varying colors and distinctive visual design aspects.

* * * * *